US007304561B2

(12) United States Patent
Lim et al.

(10) Patent No.: US 7,304,561 B2
(45) Date of Patent: Dec. 4, 2007

(54) MOTOR OVERLOAD PROTECTOR

(75) Inventors: Adrian W. Lim, North Attleboro, MA (US); Russell P. Brodeur, Rehoboth, MA (US)

(73) Assignee: Sensata Technologies, Inc., Attleboro, MA (US)

( * ) Notice: Subject to any disclaimer, the term of this patent is extended or adjusted under 35 U.S.C. 154(b) by 258 days.

(21) Appl. No.: 11/179,141

(22) Filed: Jul. 12, 2005

(65) Prior Publication Data

US 2006/0077610 A1 Apr. 13, 2006

Related U.S. Application Data

(60) Provisional application No. 60/618,083, filed on Oct. 12, 2004.

(51) Int. Cl.
*H01H 37/04* (2006.01)
*H01H 37/02* (2006.01)

(52) U.S. Cl. ..... 337/112; 337/110; 337/97

(58) Field of Classification Search ..... 337/110, 337/97, 112, 113, 102, 107; 361/673; 218/155; 200/293, 302.1

See application file for complete search history.

(56) References Cited

U.S. PATENT DOCUMENTS 3,452,313 A * 6/1969 Perry ..... 337/86
3,564,185 A * 2/1971 Bauer ..... 200/246
3,579,167 A 5/1971 Grable
3,590,174 A * 6/1971 Williams, III ..... 200/10
3,601,568 A * 8/1971 Sorenson ..... 200/304
3,959,762 A * 5/1976 Senor ..... 337/102
4,551,701 A * 11/1985 Ubukata et al. ..... 337/97
4,555,686 A * 11/1985 Pejouhy et al. ..... 337/102
4,701,824 A * 10/1987 Beggs et al. ..... 361/24
4,706,152 A 11/1987 DeFilippis et al.

(Continued)

FOREIGN PATENT DOCUMENTS

EP 0 773 560 A2 5/1997

(Continued)

*Primary Examiner*—Anatoly Vortman
(74) *Attorney, Agent, or Firm*—Russell E. Baumann

(57) ABSTRACT

An enclosed motor protector has a housing formed by a base (10) and a cover (12) received on the base and enclosing a recess (10*a*) formed in the base. A first terminal (14) extends through an opening in the housing and mounts a stationary contact (14*c*) within the recess. An elongated movable contact arm (18) is cantilever mounted at one end in the recess and mounts a second movable contact (18*a*) on a free end of the arm which is adapted to move into and out of engagement with the stationary contact. A heater (20) is mounted in the recess in heat transfer relation with a snap acting thermostatic disc (22) disposed adjacent to the movable contact arm so that upon reaching a preselected temperature the disc will snap from one dished configuration to an opposite dished configuration with its motion transferred to the movable contact arm to move the contacts out of engagement. The cover is formed with a first multiple wall barrier (122) in the form of a triangular body when seen in a lateral cross section closing a first terminal receiving opening and a second multiple wall barrier (124) closing a second terminal receiving opening to interrupt the travel of arcs and the inlet of explosive gas to the enclosure. These features also diminish air supply in the enclosure to thereby weaken any combustion.

8 Claims, 19 Drawing Sheets

U.S. PATENT DOCUMENTS

| | | | | | |
|---|---|---|---|---|---|
| 4,780,697 | A | * | 10/1988 | Cobb et al. | 337/70 |
| 4,812,799 | A | * | 3/1989 | Cobb et al. | 337/70 |
| 4,827,233 | A | * | 5/1989 | Cobb, III | 335/201 |
| 4,837,545 | A | * | 6/1989 | Cobb et al. | 337/66 |
| 4,937,548 | A | * | 6/1990 | Sdunek | 337/70 |
| 5,107,241 | A | * | 4/1992 | Ubukata et al. | 337/368 |

FOREIGN PATENT DOCUMENTS

| | | | | |
|---|---|---|---|---|
| EP | 0 890 967 | A2 | | 1/1999 |
| GB | 1 567 567 | A | | 5/1980 |
| GB | 2063566 | A | * | 6/1981 |
| JP | 2002260507 | A | * | 9/2002 |

* cited by examiner

Prior Art

Prior Art

Prior Art

Prior Art

Prior Art

Prior Art

Prior Art

Prior Art

Prior Art

MOTOR OVERLOAD PROTECTOR

CROSS-REFERENCE TO RELATED APPLICATIONS

Benefit is claimed under 35 U.S.C. Section 119(e) (1) of Provisional Application No. 60/618,083, filed Oct. 12, 2004.

FIELD OF THE INVENTION

This invention relates generally to motor protectors and more particularly to electrical enclosed break devices.

BACKGROUND OF THE INVENTION

U.S. Pat. No. 4,706,152, assigned to Texas Instruments Incorporated, relates to an enclosed break device known as the 4TM and the 5TM. An enclosed break device, according to the International Electrotechnical Commission (IEC) Standard 60079-15 second edition 2001-02, is a "device incorporating electrical contacts that are made and broken and that will withstand an internal explosion of the flammable gas or vapor which may enter it without suffering damage and without communicating the internal explosion to the external flammable gas or vapor." The 4TM and 5TM devices which have been made in accordance with the referenced patent comply with the first edition of the IEC standard 60079-15 which requires that enclosed break devices pass a make-and-break test 3 times without communicating an internal explosion to external flammable gas or vapor.

However, such devices may not meet the requirement of the second edition IEC Standard 60079-15, which requires that an enclosed break device pass a make-and-break test 10 times.

SUMMARY OF THE INVENTION

It is an object of the present invention to provide a 4TM/5TM type device that complies with the second edition (2001-02) IEC Standard 60079-15.

Another object of the invention is the provision of an internal break device that can be subjected to a make-and-break test ten times without communicating an internal explosion to external flammable gas or vapor.

A conventional 4TM/5TM type device comprises a base of electrically insulative material in which an elongated recess is formed. A first terminal is mounted at a first end and provided with a contact mounting portion disposed within the recess with a stationary contact mounted thereon. An elongated movable contact arm has a first end fixedly mounted on a mounting portion connected to another terminal. A movable contact is mounted on a free end of the movable contact arm and is arranged to move into and out of engagement with the stationary contact. A well is formed intermediate to the ends of the elongated recess and a heater is disposed therein in heat transfer relation to a thermostatic disc seated in the base over the well. The disc is adapted to snap from one dished configuration to an opposite dished configuration upon being heated to a preselected temperature. When the disc snaps it transfers motion to the movable contact arm causing the movable contact to move out of engagement with the stationary contact thereby interrupting the circuit path therethrough. A cover of electrically insulative material is received on the base to enclose the switch mechanism. However, there are two paths leading from the electrical contacts to openings at locations between the cover and base where the cover side wall is not interdigitated with the base, or closed, with a notched seating ledge of the base or comparable blocking protrusions of the cover. These locations allow flammable gas outside the protector housing to enter into the housing and enable internal arcing to ignite the flammable gas outside the device. The first path is shown by lines 2*a* of FIGS. 3 and 6 which extend directly from the contacts through slots/openings between the first terminal blade portion and the side walls of the slots/openings of the base and the cover. The second path is shown by lines 2*b* (FIG. 3) which extends from the contacts over the wall at the back portion of the contact receiving end of the recess.

According to a preferred embodiment of the invention, the cover is modified by forming first and second multiple wall barriers to impede the travel of arcs from the make-and-break contacts. The first multiple wall barrier comprises spaced apart wall portions which are received on the mounting portion of the first terminal closely adjacent to the stationary and movable contacts. According to a feature of the invention, the wall portions form a generally triangular configuration with respect to a cross section taken parallel to the bottom wall of the base. This structure also serves to decrease the volume of space between the base and cover thereby minimizing the supply of fuel to an internal explosion. According to another modification of the cover a vertically extending notch is formed in the walls which interfit with a corner portion of a corresponding side wall of the base to further inhibit arc travel. The second multiple wall barrier comprises another set of spaced apart wall portions along the perimeter of the base at a side of the first end of the recess to limit travel of arcing from the contacts and to further decrease excess volume of space. In another preferred embodiment of the invention, the various openings formed in the housing of the device are sealed by epoxy to prevent propagation of any internal explosion from external flammable gas. The sealing can be utilized by itself or along with the cover modifications noted above.

BRIEF DESCRIPTION OF THE DRAWINGS

Other objects and features of the invention will become apparent by reference to the following detailed description of preferred embodiments when considered in connection with the accompanying drawings in which like reference characters refer to like components or structural features throughout the several views wherein.

DETAILED DESCRIPTION OF PREFERRED EMBODIMENTS

In the following description references made to top, bottom, side and the like relate to the orientation of the device as shown in FIGS. 3, 5, 8, 9, 13 and 15.

Figure 1:
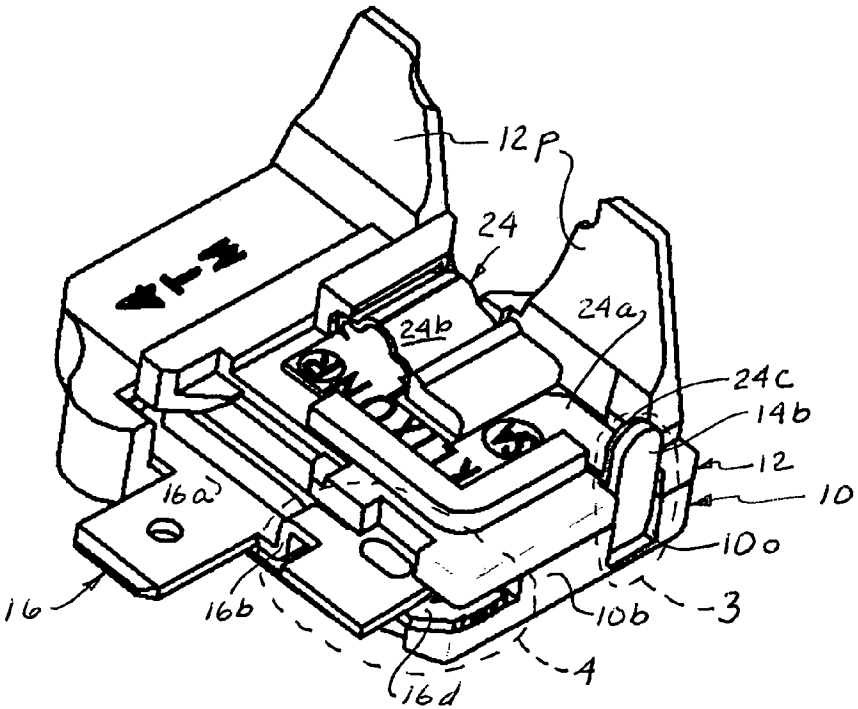
FIG. 1 is a perspective view of a 4TM/5TM device taken from above the device.
Figure 2:
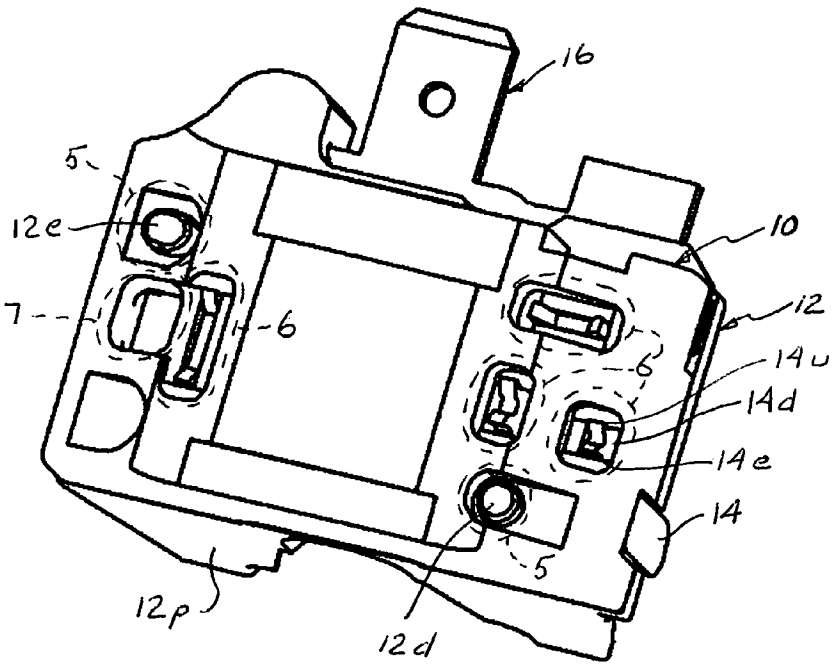
FIG. 2 is a perspective view of the FIG. 1 device taken from the same position but with the device rotated half a turn upwardly into the paper as seen in FIG. 1.
Figure 3A:
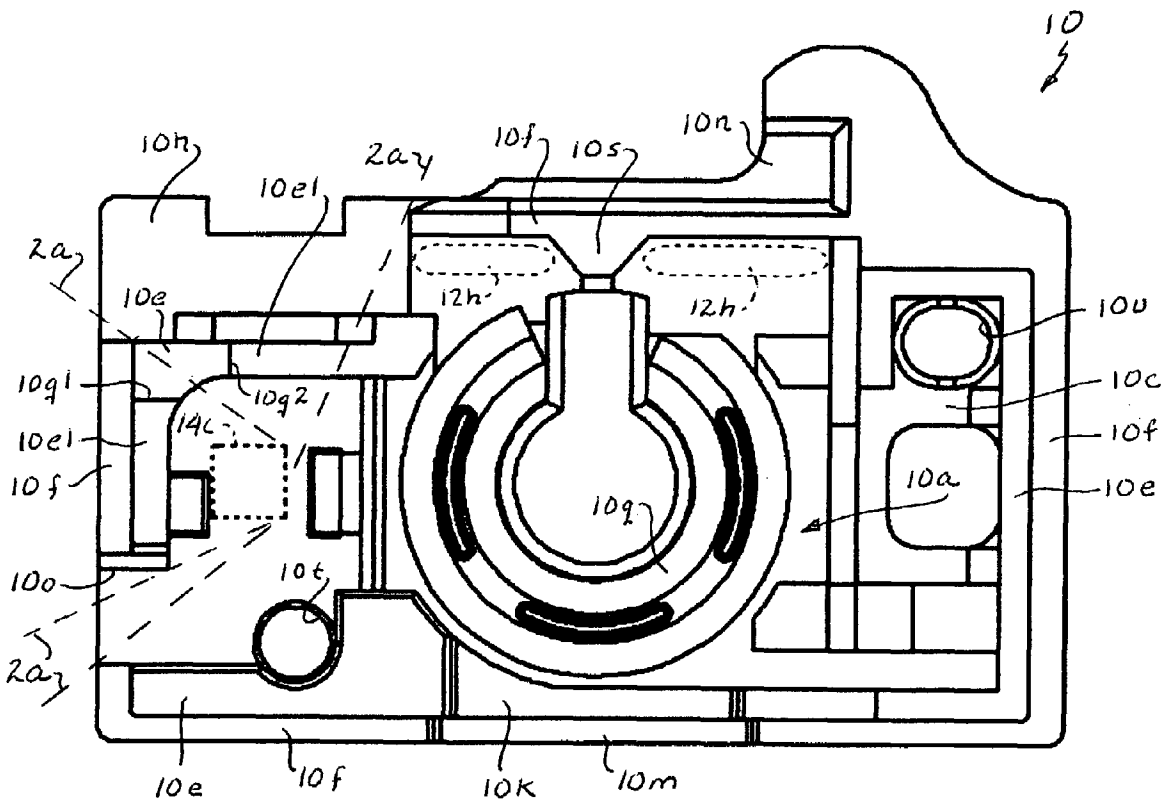
FIG. 3*a* is a top plan view of the base of the device prior to the installation of components therein and FIG. 3*b* is a view similar to FIG. 3*a* shown at a slight angle relative to the position of FIG. 3*a* to better illustrate the relative heights of the various surfaces of the base.
Figure 3B:
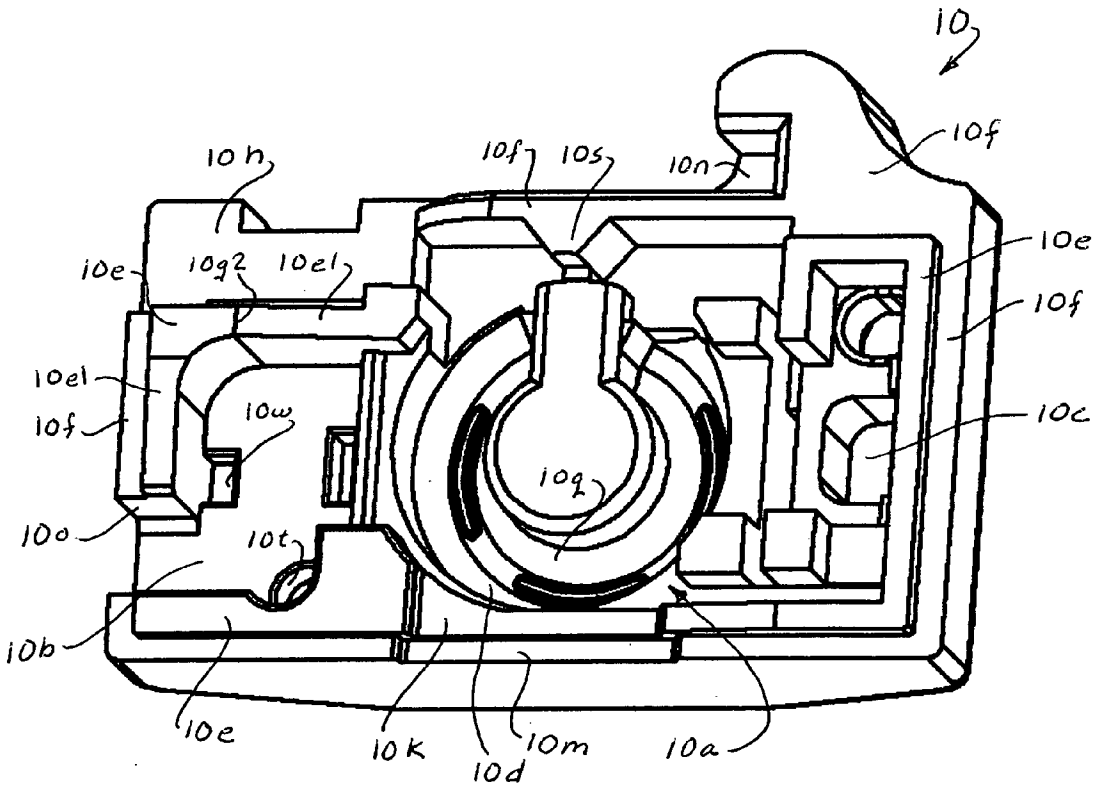

With reference to FIGS. 1-5, the 4TM and 5TM devices referenced above comprise a housing having a generally rectangular base 10 having a major length along the front of the device and a minor length from front to back of the device. A recess 10*a* is formed in the base and a cover 12 is received thereon closing the recess. First and second guide pin holes 10*t*, 10*u* are formed in the bottom wall for reception of cover guide pins 12*d*, 12*e*, respectively, to be discussed. With particular reference to FIG. 3, recess 10*a* is generally elongated in the direction of the major length having a contact receiving end 10*b*, an opposite movable contact arm mounting end 10*c* and a central heater receiving portion 10*d* intermediate to the two ends. Contact receiving end 10*b* of the recess is defined by side wall portions 10*e* on the front, and 10*e* and 10*e*1 tapered downwardly from line 10*g*1 on the left side of the base as seen in FIG. 3 with an offset lower seating ledge 10*f* contiguous with these portions on the front and left sides. The back side of the contact receiving end of the recess is defined by wall portion 10*e* with a downward tapered portion extending from line 10*g* on to the right extreme of that wall portion as viewed in FIG. 3. As will be discussed below, there is no seating ledge along the back portion of the contact receiving end of the recess. Outboard of the back side of the contact receiving end of the recess defining wall is a downwardly spaced terminal receiving ledge 10*h*. Central heater receiving portion 10*d* is defined on the front by a downwardly offset portion 10*k* along with an outer downwardly further offset ledge 10*m* and on the back side by wall portion 10*f*. Outboard of wall portion 10*f* defining the central heater receiving portion 10*d* of the recess is another terminal receiving ledge 10*n* offset further downwardly than terminal receiving ledge 10*h*, i.e., ledge 10*n* is closer to the bottom wall of the base than is ledge 10*h*. The movable contact arm mounting end 10*c* of the recess is defined by side wall 10*e* with outer wall portion 10*f* serving as a seating ledge.

Figure 5A:
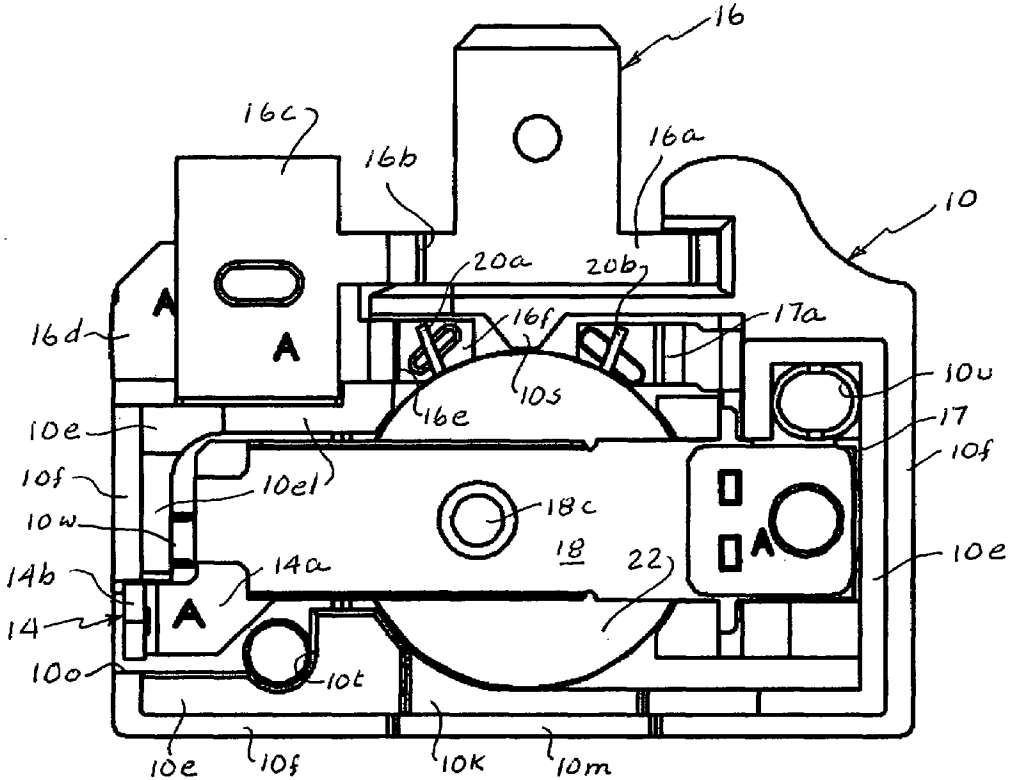
FIG. 5*a* is a top plan view of the FIG. 1 device as it existed prior to the instant invention with the cover removed.
Figure 5B:
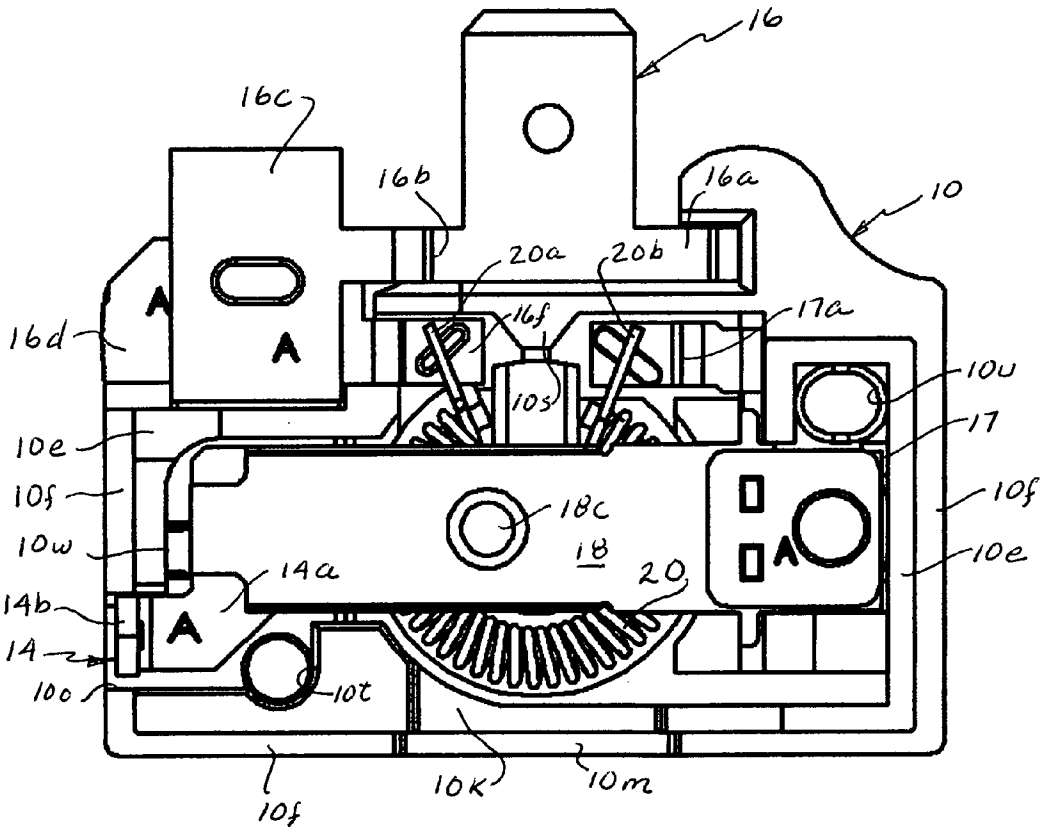
FIG. 5*b* is the same as FIG. 5*a* but with the snap acting disc removed for purposes of illustration.
Figure 5C:
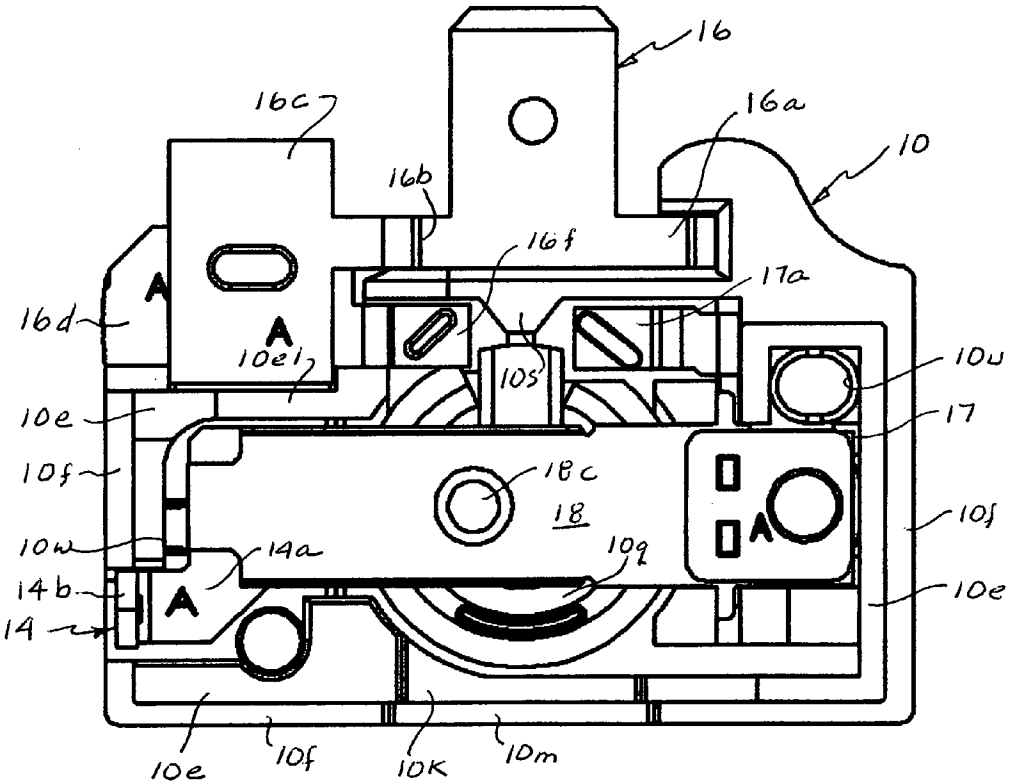
FIG. 5*c* is the same as FIG. 5*a* but with the disc and heater element removed for purposes of illustration.
Figure 6:
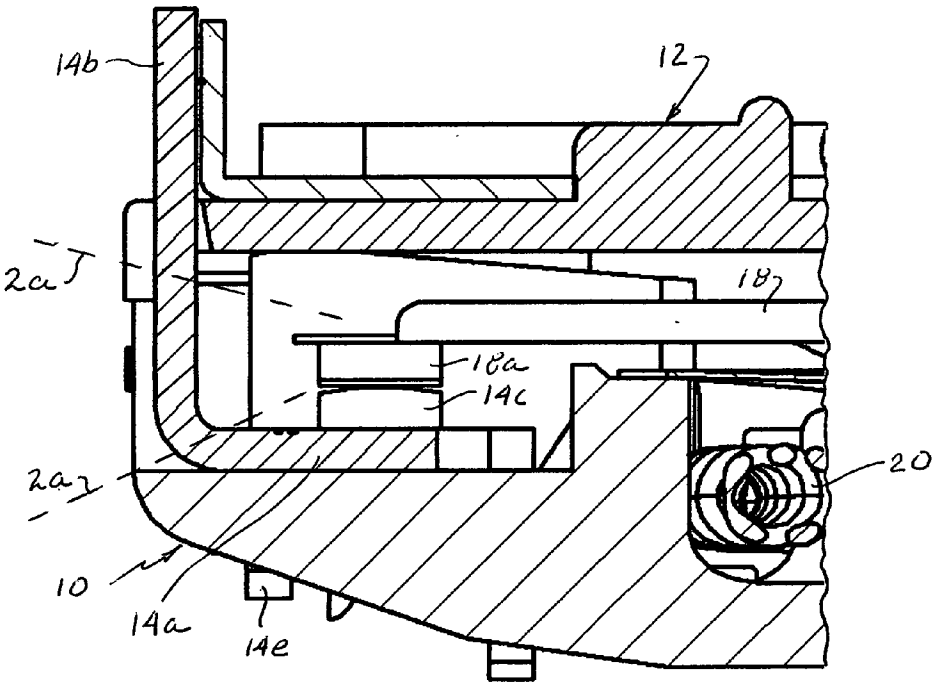
FIG. 6 is a broken away cross section in the direction of a front elevational view of FIGS. 5*a*-5*c* device taken through the make-and-break contacts.

With particular reference to FIGS. 3 and 5*a*, a slot 10*o* is formed in side wall 10*e* defining the left side of contact receiving end 10*b* of the recess for reception of a first terminal 14 to be discussed. A second terminal 16 has a base portion 16*a* received on ledge 10*n* and has a transversely extending step portion 16*b* extending up to a higher level to a body portion 16*c*. A separate electrically conductive terminal strip 16*d* is received on terminal receiving ledge 10*h* and is provided with a transversely extending step portion 16*e* extending down to the bottom of the central heater receiving recess portion in a space 10*r* between wall portion 10*f* defining the back of the central heater receiving portion of the recess and the central heater receiving portion of the recess 10*d* with the end 16*f* of strip portion 16*d* serving as a connection location for one end 20*a* of a heater 20, to be discussed, disposed in an annular well 10*q* in the recess. The body portion 16*c* of the second terminal 16 is fixedly and electrically connected to terminal strip 16*d* on ledge portion 10*h*, as by welding.

First terminal 14 has a first, generally flat mounting portion 14*a* disposed at the contact receiving end 10*b* of recess 10*a*, an arm 14*d* which projects downwardly through an opening 10*w* in the bottom wall of the base and formed with a pair of clamping fingers 14*e* which are spread apart after being received through opening 10*w* to secure the mounting portion. First terminal 14 has a second portion 14*b* that includes an interconnection blade portion extending out of an opening in the side wall of the housing.

Figure 11:
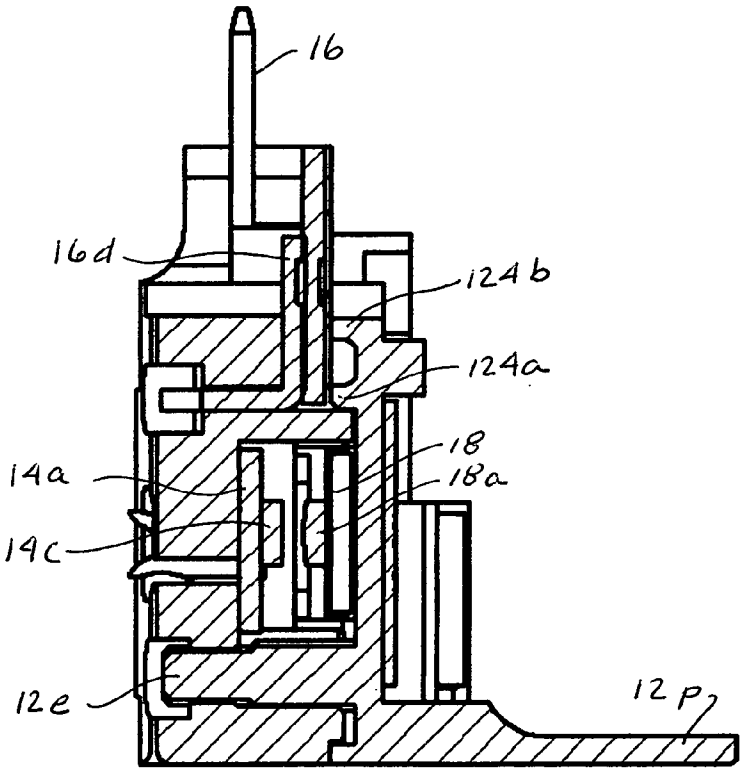
FIG. 11 is an elevational cross section taken on line 11-11 of FIG. 9.
Figure 12:
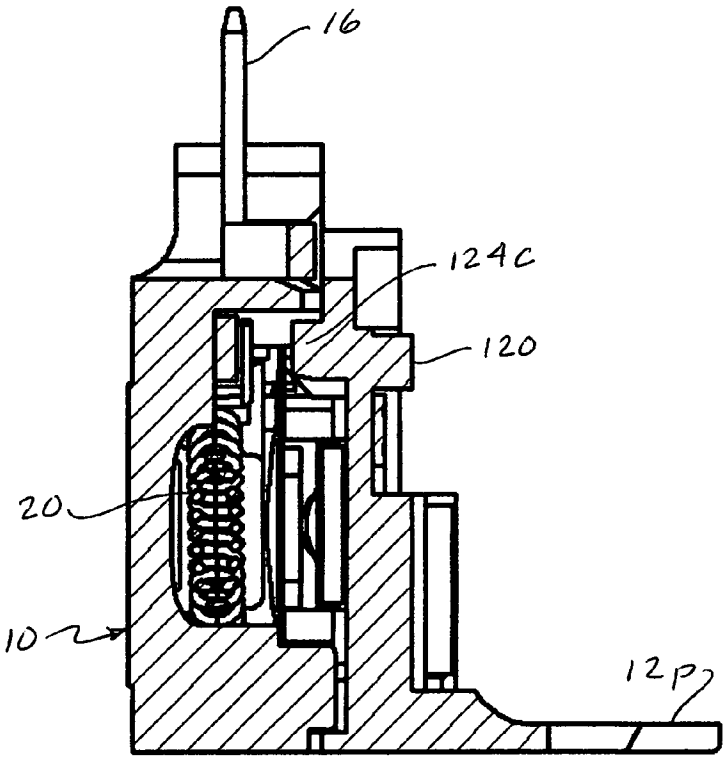
FIG. 12 is an elevational cross section taken on line 12-12 of FIG. 9.

An electrically conductive movable contact arm mounting platform 17, see FIGS. 5*a* and 11, received in movable contact arm mounting end 10*c* of recess 10*a*, is provided with an arm that steps down to an end portion 17*a* at a location in annular well 10*q* on the opposite side of a vertically extending rib 10*s* of wall 10*f* from end 16*f* of strip portion 16*d*. End portion 17*a* of the arm of platform 17 serves as a connection point for the second end 20*b* of heater 20. Platform 17 is fixedly and electrically connected to an end 18*b* of an elongated movable contact arm 18 which extends in the direction of the major length of recess 10*a*. A movable contact 18*a* is mounted on the bottom surface of movable contact arm 18 at its free end and is arranged to move into and out of electrical engagement with a stationary contact 14*c* mounted on mounting portion 14*a* of the first terminal.

A third pin receiving terminal 24 (FIG. 1) has a body portion 24*a* received on the top surface of cover 12 with pin receiving portion 24*b* aligned with the space between ears 12*p* of the cover. Terminal 24 has an arm 24*c* which extends over to the blade portion 14*b* of first terminal 14 and is electrically connected thereto, as by welding.

As noted above, heater 20 (see FIG. 5*b*) is disposed in well 10*q* of central heater receiving portion 10*d* of recess 10*a* and a thermostatic, snap acting disc 22 (see FIG. 5*a*) is received on a disc seat formed in that portion of recess 10*d* so that the disc is above the heater in heat transfer relation therewith. Disc 22 is arranged so that at normal ambient temperature the disc is in a first dished shape configuration out of engagement with movable contact arm 18 however, upon reaching a predetermined actuation temperature, the disc snaps to a second, opposite dished configuration engaging dimple 18*c* of movable contact arm 18 and moves the movable contact 18*a* out of engagement with stationary contact 14*c* thereby opening the electrical path between terminals 16 and 18.

Figure 4:
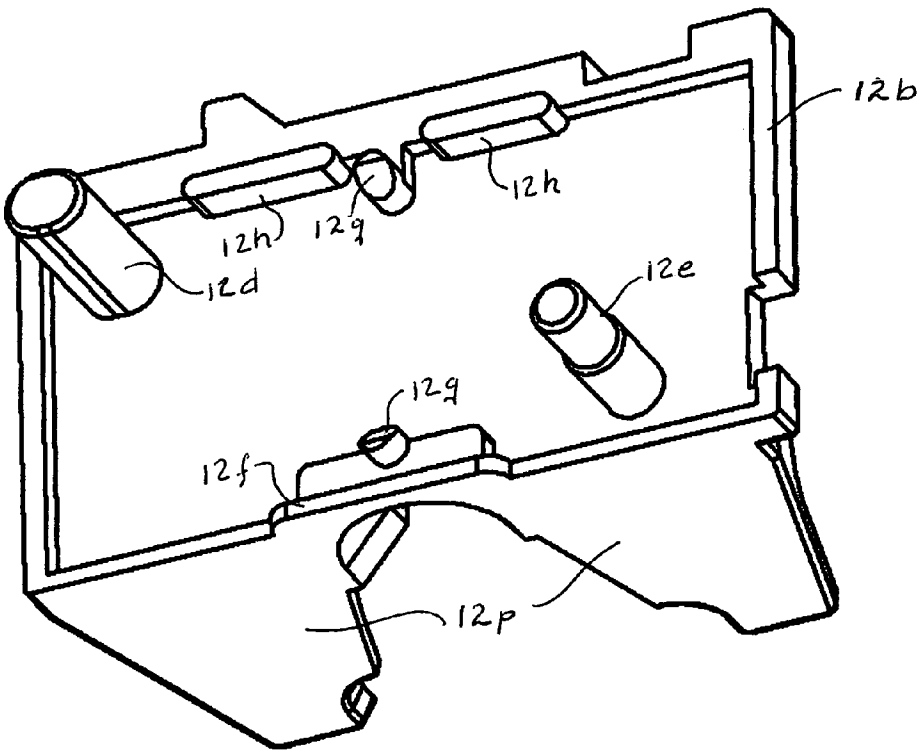
FIG. 4 is a perspective view of the cover of the FIG. 1 device as it existed prior to the instant invention taken generally in the FIG. 2 orientation.

Cover 12, shown best in FIG. 4 and shown inverted relative to FIG. 1, is formed with a recess closing wall 12*a* and side walls 12*b* formed generally around the outer perimeter of recess closing wall 12*a* and extend orthogonally therefrom side walls 12*b* are alignable with seating ledge portion 10*f* of side walls 10*e* of base 10. A slot or opening 12*c* formed in side wall 12*b*, extends into recess closing wall 12*a* and is alignable with slot or opening 10*o* in the base, to provide access for blade portion 14*b* of terminal 14. First and second alignment posts 12*d*, 12*e*, respectively, extend orthogonally from recess closing wall 12*a* and are adapted to be received in matching bores 10*t*, 10*u*, respectively, in base 10. Side wall 12*b* is extended in height at central front portion 12*f* and is adapted to be received on seating ledge 10*m* of the base, i.e., extending beyond wall portion 10*k* to provide an interdigitated or closed fit with wall portion 12*f* received in a step between wall portion 10*k* and 10*m*. Also shown in FIG. 4 are first and second disc retaining pins 12*g* disposed at opposed locations alignable with outer peripheral portions of the disc seat. First and second elongated blocks 12*h* are formed on wall 12*a* extending along the major wall length contiguous with side wall 12*b* on either side of one of the disc retaining pins and extending in height beyond side wall 12*b*.

Although protectors made as shown in FIGS. 1-5 have performed extremely well and have been widely used in various industries, certain aspects of the devices need to be modified to ensure that the devices comply with recent changes in the requirements of the International Electrotechnical Commission Standard relating to "enclosed break devices" discussed above. With particular reference to FIGS. 3, 5*a*-5*c* and 6, there are two paths leading from contacts 18*a*, 14*c* to openings at locations between the cover and the base where the cover side wall is not interdigitated with the base, or closed, with a notched seating ledge of the base, or the like. These locations allow flammable gas outside the protector housing to enter into the housing and enable internal arcing to ignite the flammable gas outside the device. The first path is shown by lines 2*a* (FIGS. 3 and 6) which extend directly from the contacts through slots/openings 10*o* of the base and 12*c* of the cover between terminal blade portion 14*b* and the side walls of slots/openings 10*o* of base 10 and 12*c* of cover 12. The second path is shown by lines 2*b* (FIG. 3) which extends from the contacts over wall 10*e* and 10*e*1 at the back portion of contact portion end 10*b* of recess 10*a* and wall 10*f* of the central heater receiving recess 10*d*.

Figure 7:
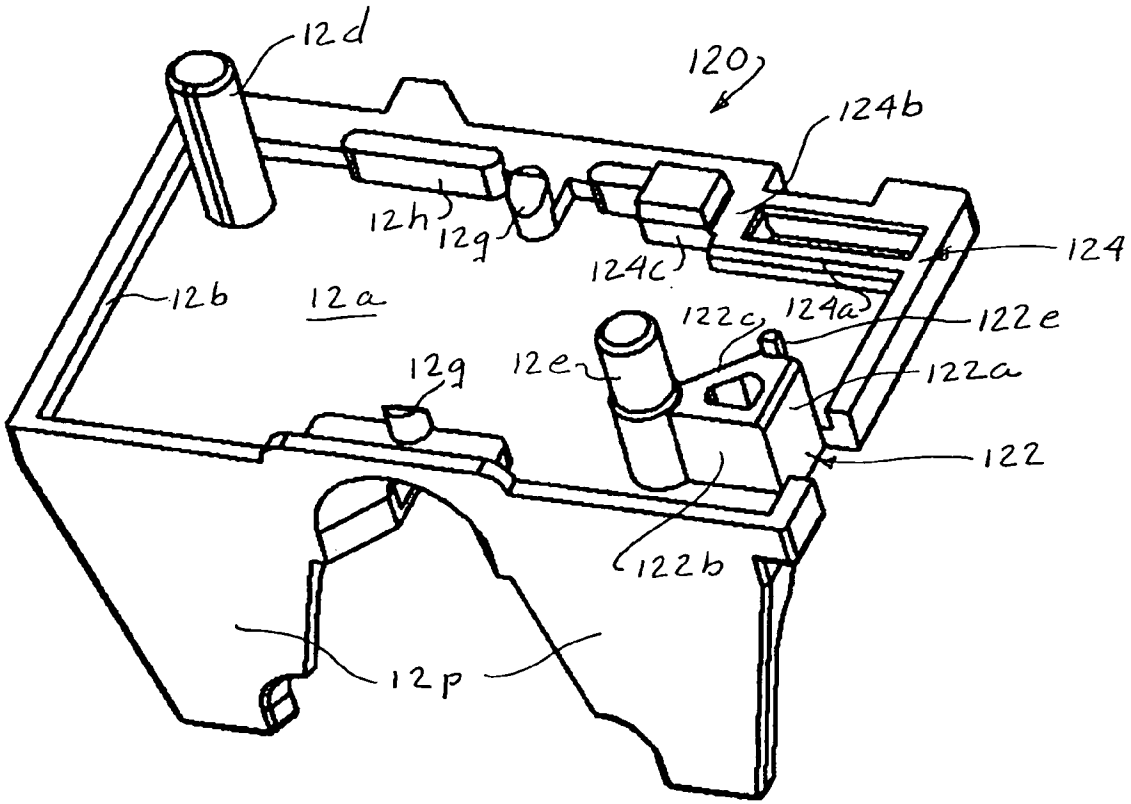
FIG. 7 is a view similar to FIG. 4 of a cover made in accordance with a preferred embodiment of the invention.
Figure 10:
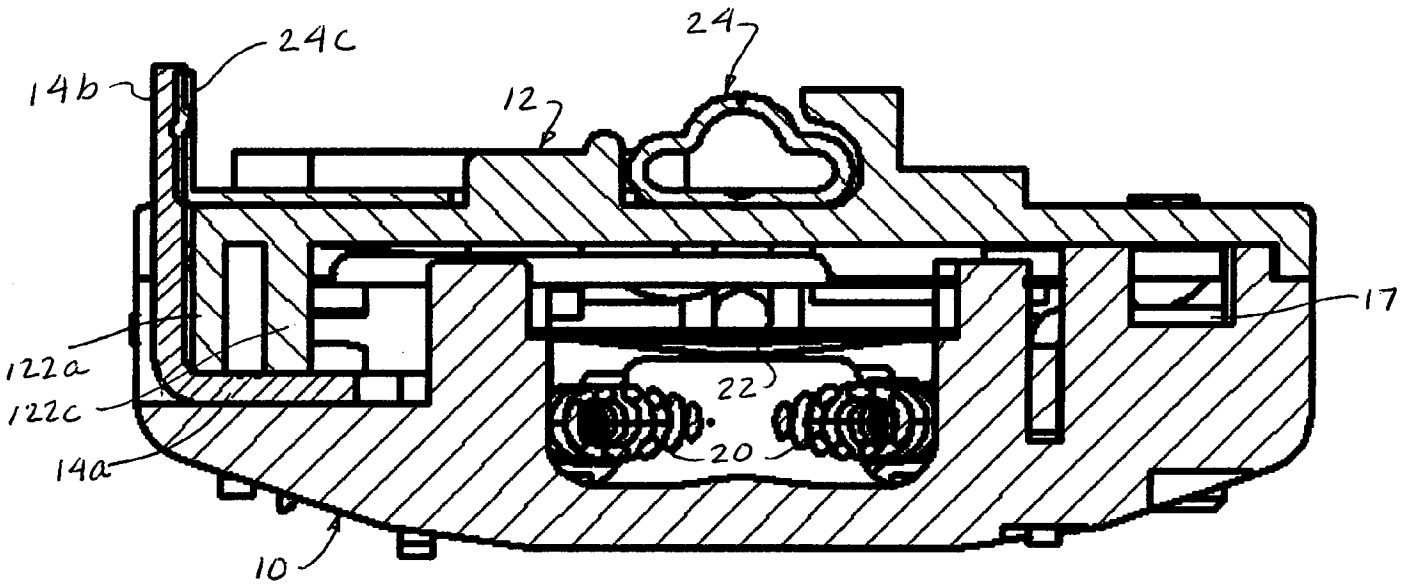
FIG. 10 is an elevational cross section taken on line 10-10 of FIG. 9.

A modified cover 120 (see FIG. 7) made in accordance with a first feature of a preferred embodiment of the invention comprises a first multiple wall barrier 122 extending from recess closing wall 12*a* comprising a first wall 122*a* orthogonally from wall 12*a* and disposed so that it is essentially flush with the inner surface of terminal receiving slot 10*o* and extends from the recess closing wall 12*a* generally to horizontally extending flat portion 14*b* of terminal 14 when the cover is received on the base (see FIG. 10). Extending generally normal to wall 122*a* at a side of slot 10*o* closest to ears 12*p* is a second wall 122*b* which extends over to guide pin 12*e* and then a third wall 122*c* extends between the extremity of wall 122*a* and post 12*e* generally forming a triangular barrier wall that extends normally from recess closing wall 12*a* that not only serves to interrupt arc travel but also reduces the volume of free space between the cover and the base, that is, it reduces the amount of fuel for supporting combustion. Preferably, a notch 122*d* (FIG. 8), extending in a normal direction to recess closing wall 12*a* is formed in walls 122*a* and 122*c* at their intersection that is adapted to receive the side wall 10*e* of the base to further impede arc travel. Preferably, a portion of wall barrier 122 along wall 122*c* that forms notch 122*d* is extended at 122*e* a distance essentially the same as the thickness of a mounting portion 14*a* of terminal 14. When the cover is in plan, this extension, or knob is received in a small open space next to mounting portion 14*a* extending toward opening 10*t*. This triangular feature essentially closes off the first path 2*a* of arc travel.

A second multiple wall barrier 124 is formed in the cover so that when placed on the base the barrier is at the first end of the housing adjacent to contacts 14*c*, 18*a* along the outer periphery. The second barrier adds wall 124*a* which extends normal to recess closing wall 12*a* and generally parallel to side wall 12*b* relative to the major length of the elongated base and spaced therefrom. Wall 124*a* extends away from recess closing wall 12*a* a distance essentially the same as outer wall 12*b*. Wall 124*a* at its extremity away from side wall 12*b* on the minor length end of the cover is joined to side wall 12*b* on the major length side by wall 124*b* of the same height. Contiguous to barrier 124 and extending along side wall 12*b* in the direction of its longitudinal axis, i.e., major length, is a block 124*c*, preferably formed of the same material as the cover, the block extending vertically a distance greater than that of side wall 12*b*. Block 124*c* serves as an arc barrier filling in the space 10*r* between wall portion 10*e*, 10*e*1 adjacent to stop 16*e* of conductive strip 16*d* defined by the back part of the contact receiving recess and wall portion 10*f* in back of the central heater receiving portion of the recess.

Figure 13:
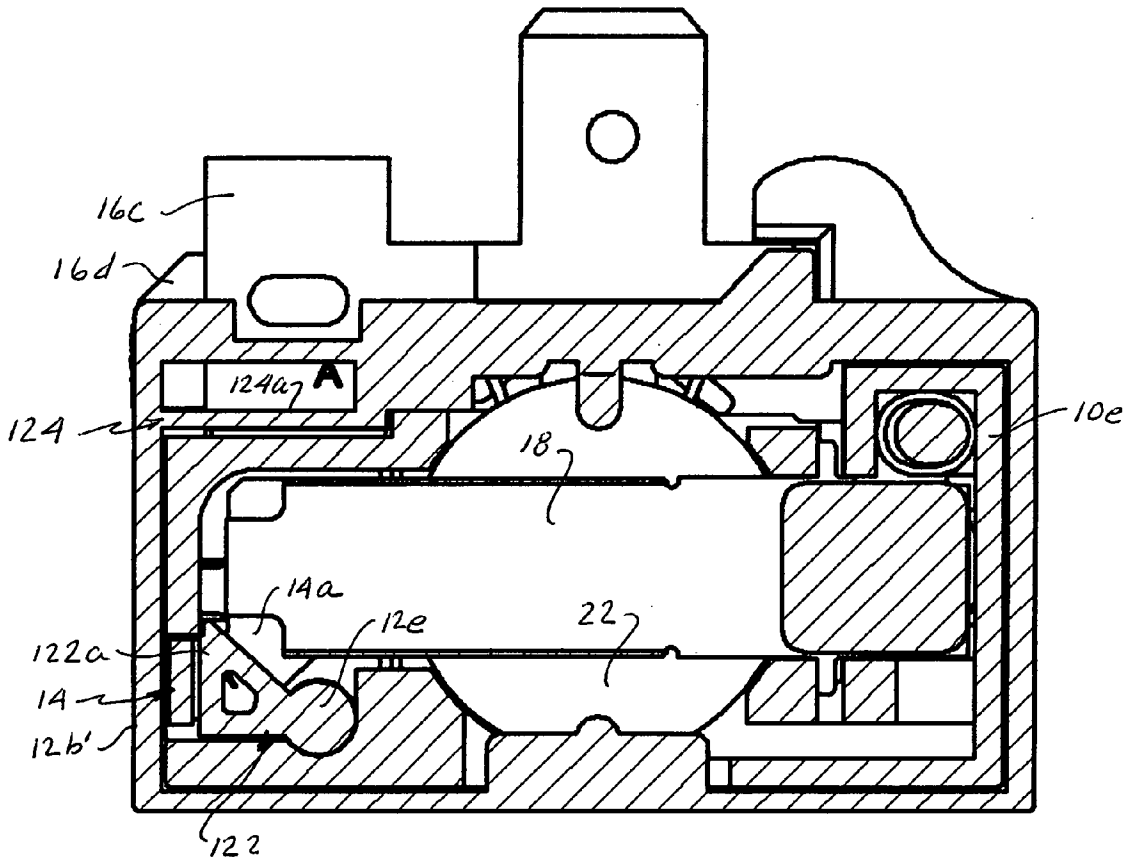
FIG. 13 is a view similar to FIG. 8 but showing an alternative preferred embodiment of the invention.
Figure 14:
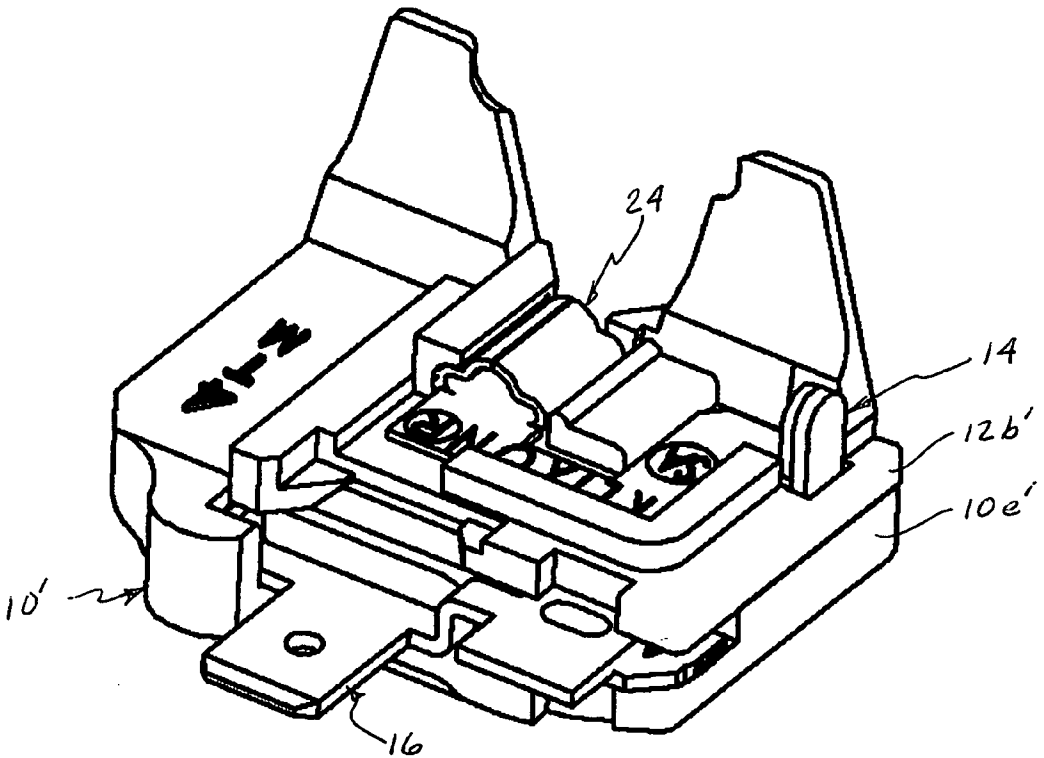
FIG. 14 is a perspective view, similar to FIG. 1 of a device made in accordance with the FIG. 13 preferred embodiment.

According to an alternative embodiment, terminal portion 14*b* can be moved inwardly away from the outer periphery of the housing as seen in FIGS. 13 and 14 with side wall portions 10*e*' and 12*b*' being continuous, that is, without slot 10*o* and 12*c* being formed in the side walls with wall 122*a* of the first barrier 122 essentially butted up against side wall 10*e* just beyond slot 10*o*. In this case, barrier 122, if desired, could be formed without notch 122*d* with barrier wall 122*a* butted up against sidewall 10*e* just beyond slot 10*o*.

Figure 8:
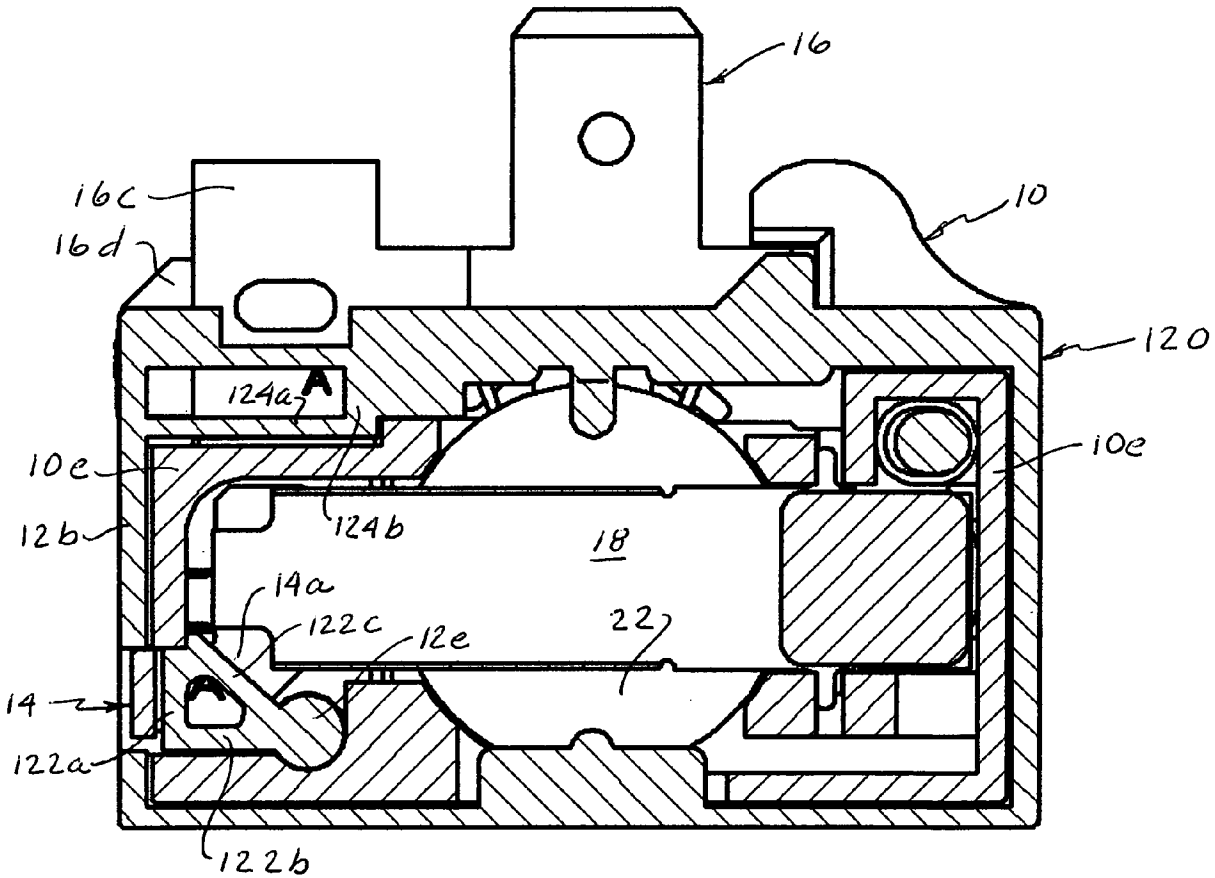
FIG. 8 is a view similar to FIG. 5*a* but is shown with a cover in a horizontal cross section, the cover incorporating the preferred embodiment shown in FIG. 7.
Figure 9:
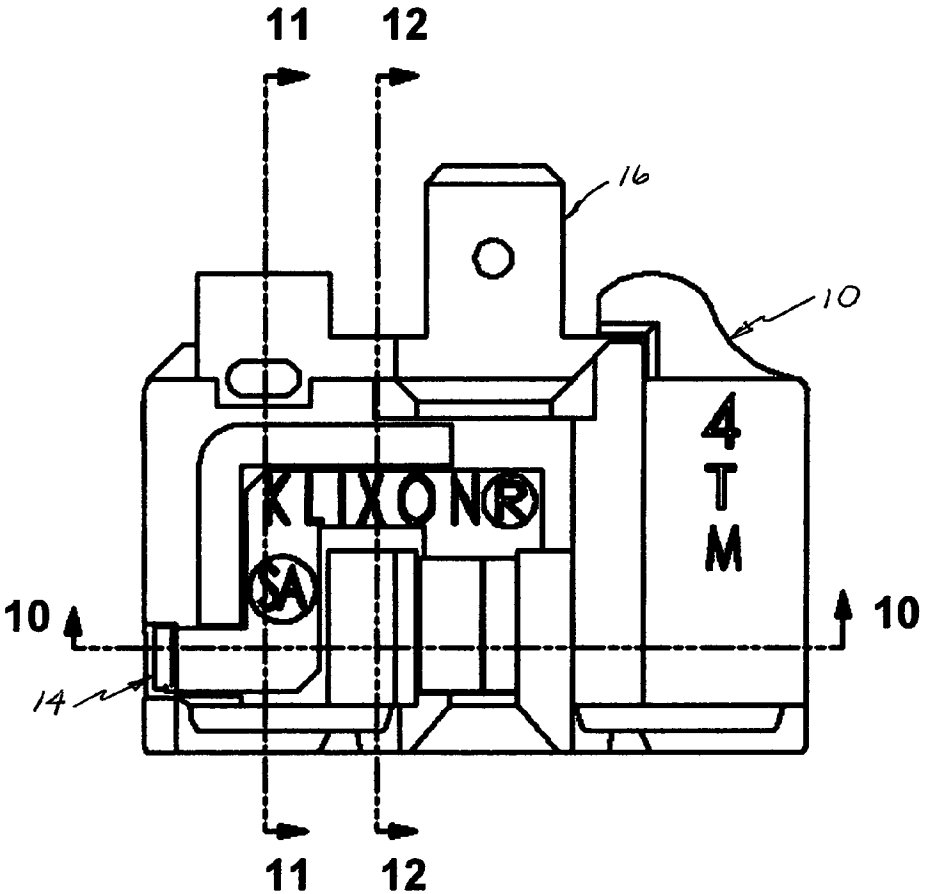
FIG. 9 is a top plan view of a 4TM and 5TM device made in accordance with the preferred embodiment of FIGS. 7 and 8.
Figure 15:
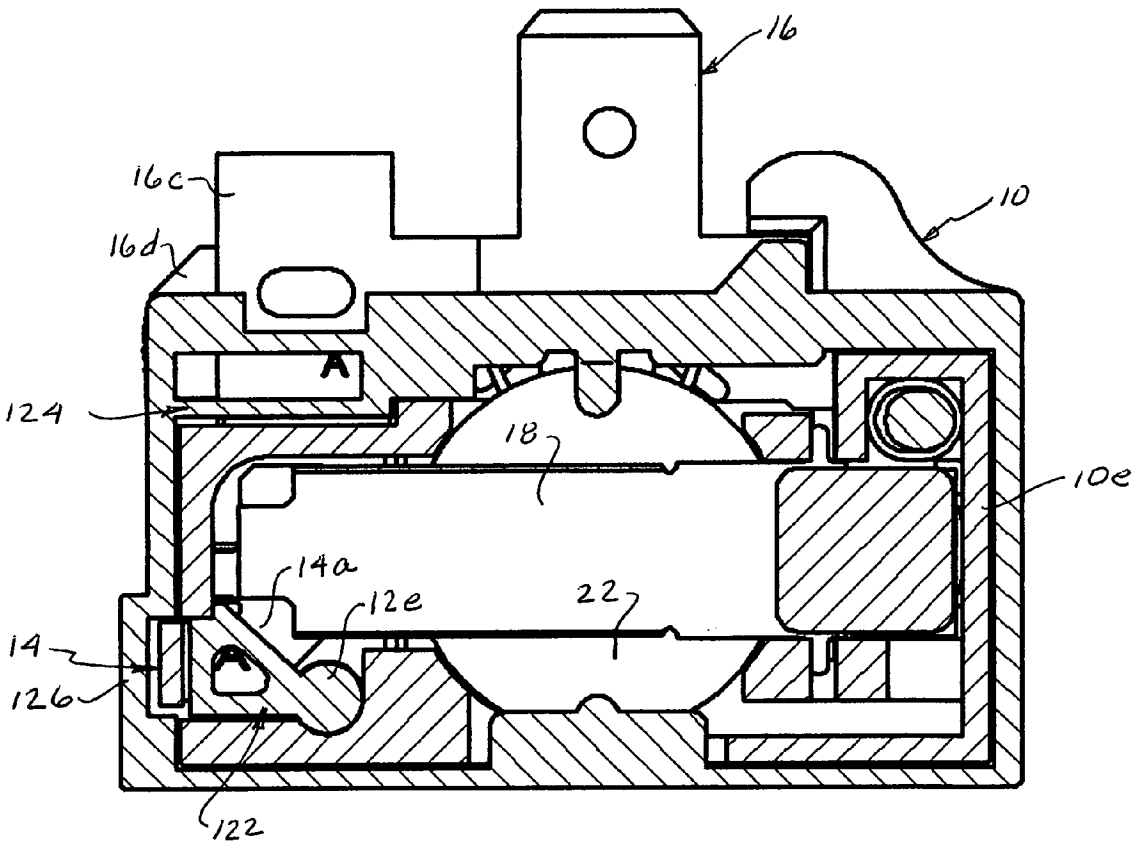
FIG. 15 is a perspective view, similar to FIGS. 8 and 13 showing another alternative preferred embodiment of the invention.
Figure 16:
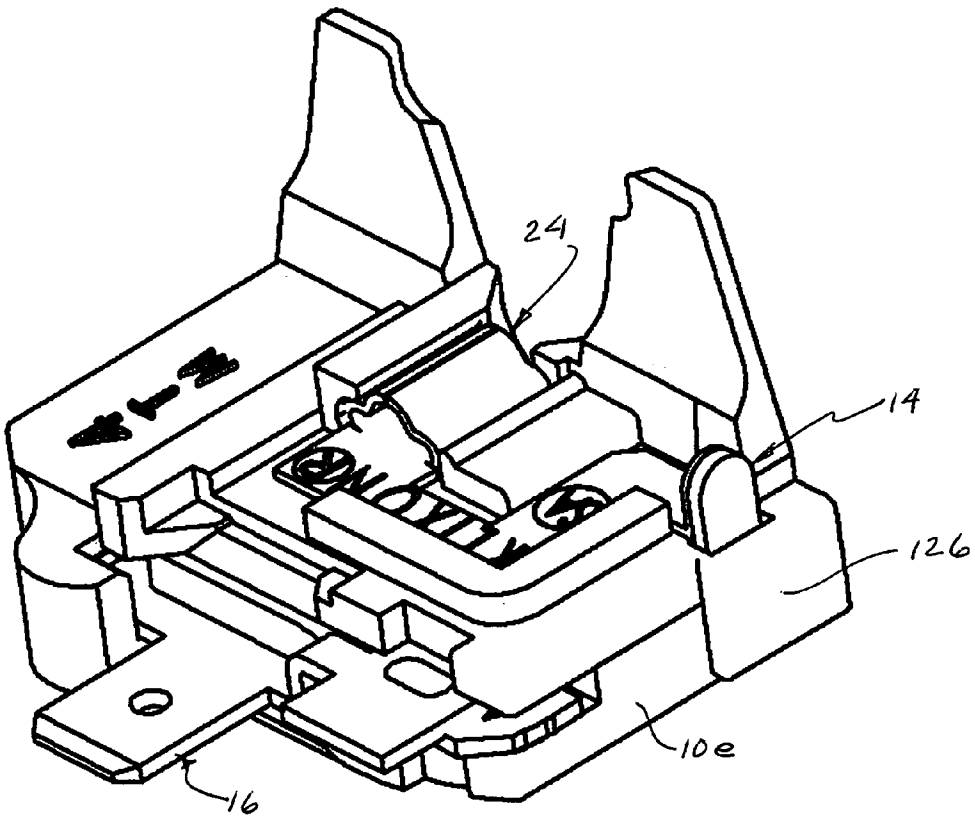
FIG. 16 is a view similar to FIG. 15 of a device made according to the FIG. 15 embodiment.

According to another alternative embodiment shown in FIGS. 15 and 16, the FIG. 1 structure can be modified by forming side wall portion 126 to extend across slot 10*o* externally thereof. The location of terminal 14 can remain as shown in FIG. 8 with a side wall 126 covering the slot 10*o*, 12*c* in side walls 10*e* of the base and 12*b* of the cover, respectively.

With reference to FIGS. 1 and 2 a number of openings are formed through the housing for various purposes, comprising openings at dashed lined locations 3 and 4 for terminals 14 and 16, 5 for guide pins 12*d*, 12*e* and 6 for clamping elements in the base and 7 for providing access to the movable contact arm mounting portion. In accordance with another embodiment of the invention, each of these openings, once the device is assembled, can be sealed with suitable epoxy. This can be done along with the above embodiments or in place of them, as desired.

Although the invention has been described with regard to specific embodiments thereof, many variation and modifications will become apparent to those of ordinary skill in the art. It is therefore, the intent that the appended claims be interpreted as broadly as possible in view of the prior art to include all such variations and modifications.

What is claimed is:

1. An enclosed protector having a housing formed by a base and a cover, a generally elongated recess formed in the base and defined by side walls of the base, the recess having opposed first and second ends, a first terminal mounted at one opposed end, the first terminal having a generally flat contact mounting portion disposed within the recess, the first terminal extending through an opening in a wall of the housing, a stationary contact mounted on the mounting portion of the first terminal, an elongated movable contact arm having first and second ends, a second terminal mounted on the base, an electrically conductive movable contact arm mounting platform electrically connected to the second terminal is disposed at the second end of the recess, the second end of the movable contact arm being electrically connected to the platform, a movable contact mounted on the first end of the movable contact arm and arranged to move into and out of engagement with the stationary contact, a thermostat metal element positioned in the recess and arranged to move the movable contact arm at preselected thermal conditions and in turn move the movable contact out of engagement with the stationary contact, the base formed with a terminal receiving ledge adjacent the first end of the recess, an electrically conductive portion received on the terminal receiving ledge and being electrically connected to the second terminal, a cover received over the base, wherein the improvement comprising a side wall on the cover having spaced apart wall portions received on the first terminal closely adjacent to the stationary and movable contacts forming a first multiple wall barrier to limit travel of arcing from the contacts, the side wall of the cover having additional spaced apart wall portions along the perimeter of the base at the first end of the recess adjacent to the terminal receiving ledge forming a second multiple wall barrier to limit travel of arcing from the contacts.

2. A protector according to claim 1 in which the wall portions of the first multiple wall barrier are joined to one another to form a hollow triangular wall barrier.

3. A protector according to claim 1 in which an upstanding notch is formed between two barrier wall portions of the first multiple wall barrier and the side wall of the base is received in the notch.

4. A protector according to claim 3 in which one side of the notch is extended in length a distance essentially the same as the thickness of the contact mounting portion of the first terminal and is received adjacent to the contact mounting portion.

5. A protector according to claim 1 further comprising another side wall portion of the cover adjacent to the multiple wall barrier but disposed externally of the first terminal.

6. A protector according to claim 1 in which the wall portions of the second multiple barrier walls lie in respective planes which are generally parallel with each other.

7. A protector according to claim 1 in which the housing is formed with openings and further comprising epoxy filling each opening to provide an environmental seal.

8. An enclosed protector comprising:

a base, a generally elongated recess formed in the base and defined by side walls of the base, the recess having opposed first and second ends, a first terminal extending through a slot formed through a side wall of the base at one opposed end, the first terminal having a generally flat contact mounting portion disposed within the recess, a stationary contact mounted on the mounting portion of the first terminal, an elongated movable contact arm having first and second ends, a second terminal having a mounting platform at the second end of the recess, the second end of the movable contact arm mounted on the mounting platform, a movable contact mounted on the first end of the movable contact arm and arranged to move into and out of engagement with the stationary contact, a cover received over the base, the cover having a side wall having first and second multiple wall barriers in which one barrier is aligned with a portion of the first terminal and the second barrier includes spaced, parallely extending wall portions along the perimeter of the base at the first end of the recess, the first and second multiple wall barriers serving to limit travel of arcing from the contacts.

* * * * *